United States Patent [19]

Murata

[11] Patent Number: 4,514,608

[45] Date of Patent: Apr. 30, 1985

[54] LOCKING TYPE PUSHBUTTON SWITCH

[75] Inventor: Taneo Murata, Iwaki, Japan

[73] Assignee: Alps Electric Co., Ltd., Tokyo, Japan

[21] Appl. No.: 558,326

[22] Filed: Dec. 5, 1983

[30] Foreign Application Priority Data

Dec. 3, 1982 [JP] Japan ..... 57-182482[U]
Dec. 3, 1982 [JP] Japan ..... 57-182483[U]

[51] Int. Cl.[3] ..... H01H 13/56
[52] U.S. Cl. ..... 200/153 J
[58] Field of Search ..... 200/153 J, 328

[56] References Cited

U.S. PATENT DOCUMENTS 4,160,143 7/1979 Schlesier et al. ..... 200/153 J
4,249,053 2/1981 Tsutui ..... 200/153 J
4,368,368 1/1983 Russenberger ..... 200/153 J

FOREIGN PATENT DOCUMENTS 2816185 10/1979 Fed. Rep. of Germany ... 200/153 J
2816869 10/1979 Fed. Rep. of Germany ... 200/153 J
6610818 2/1967 Netherlands ..... 200/153 J

*Primary Examiner*—John W. Shepperd
*Attorney, Agent, or Firm*—Guy W. Shoup; Gerard F. Dunne

[57] ABSTRACT

A locking type pushbutton switch has a lock pin adapted to engage with a heart-shaped cam groove and comprised of a pin part and a mounting part. Portions of the mounting part adjacent the pin part are cut away to enable the pin part to be made longer. Therefore the pin part has sufficient flexibility, resulting in smooth operation of the lock pin. Moreover, the lock pin is held by the upper and lower cases, and the supporting plate and spring plate normally provided are no longer necessary.

2 Claims, 13 Drawing Figures

LOCKING TYPE PUSHBUTTON SWITCH

FIELD OF THE INVENTION

This invention relates to a locking type push-button switch which closes movable contacts by locking a pushbutton through depressing operations of the pushbutton.

BACKGROUND OF THE INVENTION

A locking type pushbutton switch of this kind is represented in FIG. 1. In FIG. 1, an upper case 1 has an open lower end closed by a lower case 2, and a stem 3 is provided to move vertically through the upper wall 1*a* of the upper case 1. At the upper end of this stem 3, a pushbutton not shown is mounted. A spring 4 is provided between the stem 3 and the upper surface of upper case 1 so as to urge the stem 3 upwardly.

On opposite surfaces of the inner wall of upper case 1, grooves 1*b* and 1*b* are formed as shown in FIG. 2 A fixed plate 5 shown in FIG. 3 is inserted into the grooves 1*b* and 1*b* of the upper case 1 and fixed therein by attaching the lower case 2 to the upper case 1. A hole 6 is bored at the center of this fixed plate 5 and the one end 7*a* of a C-shaped lock pin 7 is engaged within this hole 6. The other end 7*b* of this lock pin 7 is inserted into a heart-shaped cam groove 8 of the stem 3 and is held in resilient contact with the bottom part of the heart-shaped cam groove 8 by a plate spring 9 provided between the lock pin 7 and the inner wall of upper case 1.

Moreover, the lower case 2 is provided with the terminals 10 and 11 projected downwards. Terminal 10 is integrally provided with a fixed contact 10*a* having a projection 10*b*, while the terminal 11 is provided with a movable contact 11*a*. Moreover, the fixed contact 10*a* is held within a fixed resin frame 12. This frame 12 is integrally provided with the flexible tongue piece 12*a*, and a fixed plate spring 14 is fitted over the top portion of the frame 12 to press the flexible piece 12*a* rightwardly in FIG. 1 when the stem 3 is depressed into the case 1.

In such a locking type pushbutton switch, when the pushbutton (not shown) is depressed downward, causing the stem 3 to move downwardly in opposition to the spring force of the spring 4, the plate spring 14 and flexible piece 12*a* are bent to the right in FIG. 1 and the movable contact 11*a* is placed in contact with the projection part 10*b* of the fixed contact 10*a*. Moreover, at this time, the end 7*b* of lock pin 7 slidingly moves within the heart-shaped cam groove 8 of the stem 3. After the movable contact 11*a* is in contact with the projection part 10*b*, namely when the movable contact 11*a* closes, the stem 3 is locked by the lock pin 7 and heart-shaped cam groove 8 so the stem cannot move upwards. When the pushbutton is further depressed from such a condition and is then released, the locking engagement of the lock pin in the cam groove is released and the stem 3 is returned to the initial state by a spring force of the spring 4, and the movable contact 11*a* opens. Under this condition, a stepped part (not shown) of the stem 3 is in contact with the upper wall of the upper case 1 and thereby the stem 3 is prevented from moving further upwards as a result of the spring force of the spring 4.

Recently a locking type pushbutton switch of this general type has been required which uses fewer parts, employs a simplified structure, has a small size and compact appearance, and assures smooth operation of the lock pin.

SUMMARY OF THE INVENTION

It is an object of this invention to provide a locking type pushbutton switch satisfying such requirements.

In order to attain such objects, the lock pin is comprised of a pin having an end point held resiliently in contact with the heart-shaped cam groove, and a mounting part integrated with the pin and held by the case. The abovementioned requirements are satisfied by forming a relatively long pin part by cutting away portions of the mounting part so the pin part can have increased flexibility.

DETAILED DESCRIPTION OF THE INVENTION

Figure 1:
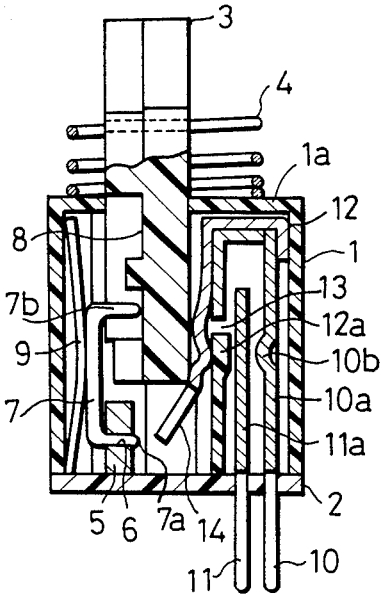
Fig.1 PRIOR ART
FIG. 1 is a cross sectional view of an existing locking type pushbutton switch.
Figure 2:
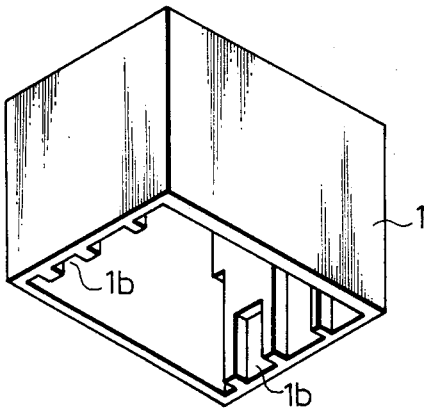
Fig.2 PRIOR ART
FIG. 2 is a perspective view of the upper case shown in FIG. 1.
Figure 3:
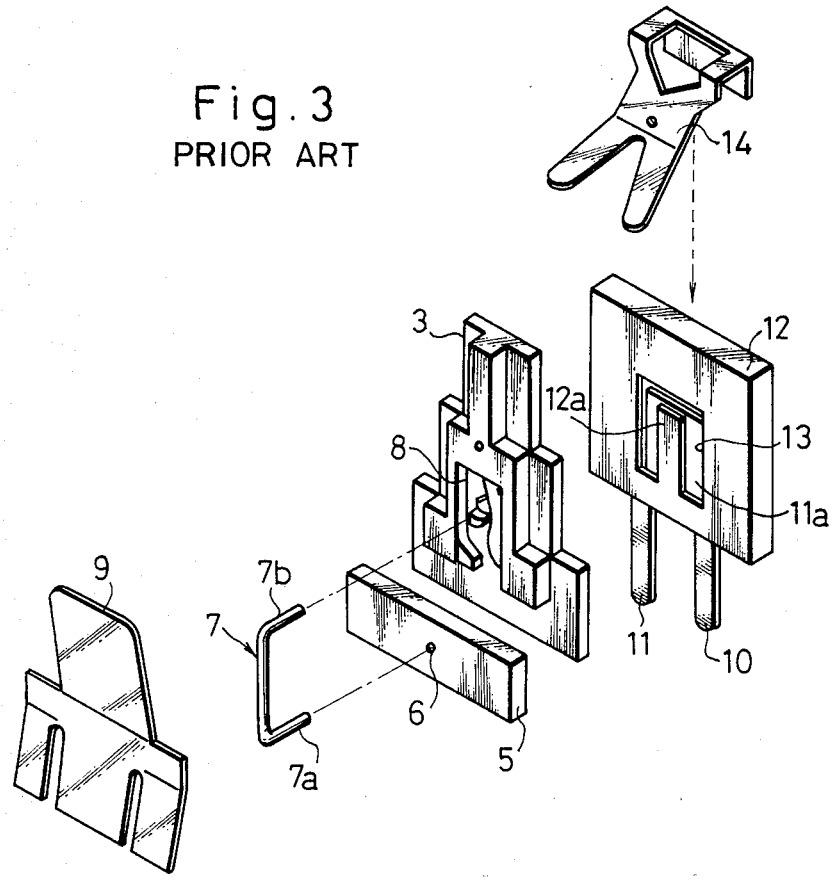
Fig. 3 PRIOR ART
FIG. 3 is a perspective view of essential components of the locking type pushbutton switch shown in FIG. 1.

The present invention will be described in detail with reference to FIG. 4 to FIG. 13. Elements the same as those in FIG. 1 to FIG. 3 are given the same reference numbers and are not further described.

Figure 10:
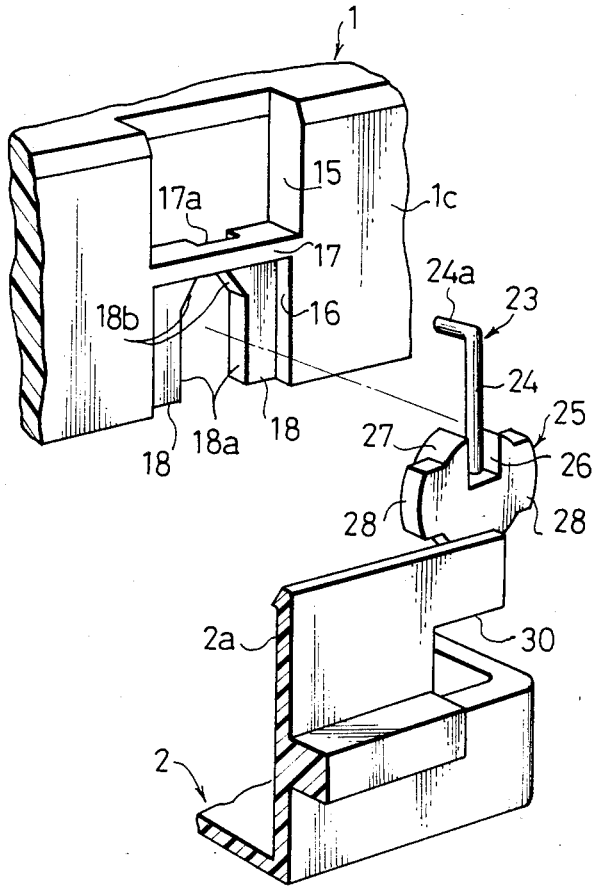
FIG. 10 is a perspective view of major parts of FIG. 4.
Figure 11:
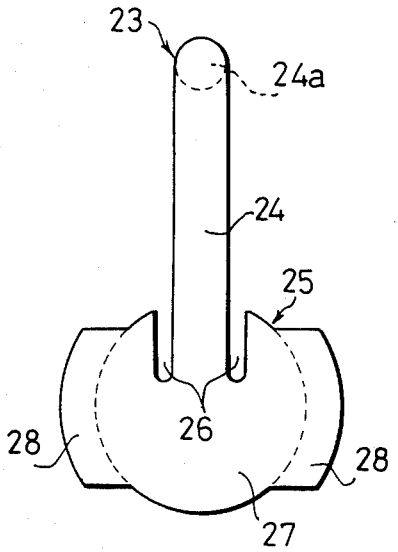
FIG. 11 is a front view of the lock pin of FIG. 4.
Figure 12:
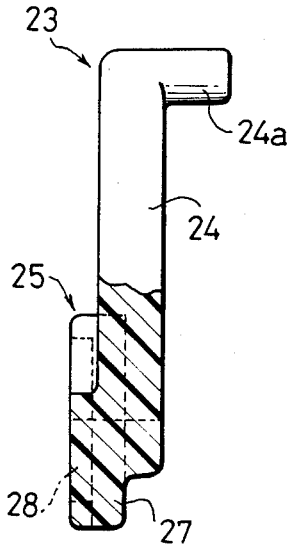
FIG. 12 is a side sectional view of a part of the lock pin of FIG. 11.
Figure 13:
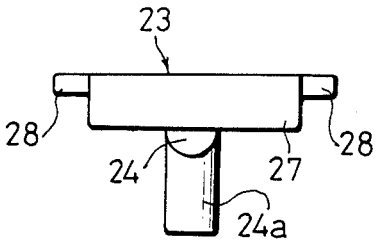
FIG. 13 is a bottom view of FIG. 11.

In FIG. 4 through FIG. 10, one side wall of the upper case 1 is provided with windows 15 and 16 cut into the upper and lower portions thereof. A crosspiece 17 between the cut-away windows 15 and 16 is provided with an indent portion 17*a* as shown in FIG. 10. The cut-away window 16 is provided with step walls 18 and 18 having side surfaces 18*a*, 18*a* and inclined side surfaces 18*b*, 18*b* connected thereto.

The end part of stem 3 inserted into the upper case 1 has a hole 19 opening at the lower end. At the upper part of this hole 19, a projection 20 is provided, while the upper surface of lower case 2 is provided with a projection 21. Between this stem 3 and lower case 2, a spring 22 is fitted around the projections 20 and 21.

A lock pin 23 is provided with, as shown in FIG. 4, FIG. 5, FIG. 11 to FIG. 13, a pin part 24 and a mounting part 25 integrated to the base thereof. The end point of a bent part 24*a* of the pin part part 24 is resiliently held in contact with the heart-shaped cam groove 8 formed in the side wall of the stem 3. In addition, the mounting part 25 is formed with a cut-away part 26 along the pin part 24. On account of this cut-away part 26, the pin part 24 can be made longer to increase its flexibility. Moreover, the lock pin 23 in such a structure is usually formed by a synthetic resin and since it is possible to make the pin part 24 flexible, it can be formed of other materials.

The circumference of circular part 27 of this lock pin 23 is adapted to be placed in contact with the side surface 18*a*, 18*a*, inclined surface 18*b*, 18*b* and the lower case 2, and the ear parts 28, 28 are provided between the side wall 2*a* of the lower case 2 and the facing surfaces of the step walls 28, 28. The pin part 24 is adapted to fit within the indent 17*a* of the crosspiece 17. Thereby, the pin part 24 of lock pin 23 can sway to the right and left within the indent 17*a*. In addition, the indent 17*a* of the crosspiece 17 is provided with an inclined surface 17*b* and thereby the pin part 24 may easily flex away from the heart-shaped cam groove formed in the stem 3.

The side walls 1*c*, 1*d* of the upper case 1 each have an engaging projection 29, and corresponding open parts 30 are provided at the side of the side walls 2*a*, 2*a'* of the lower case 2 to couple the cases 1 and 2 together.

Figure 4:
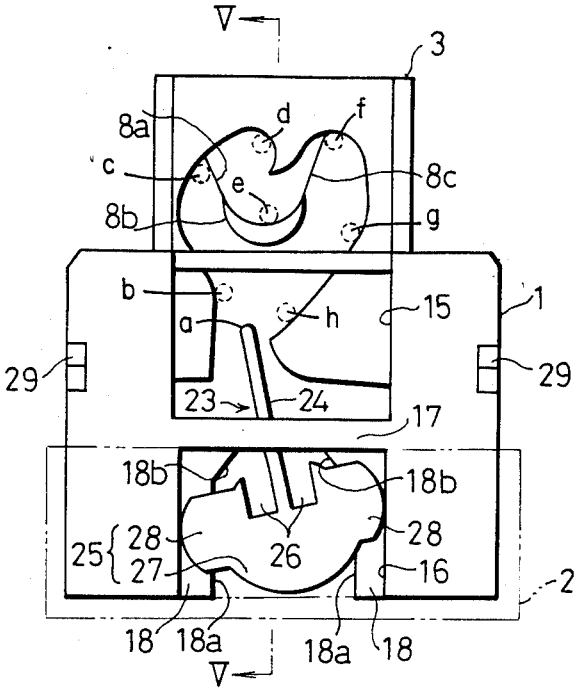
FIG. 4 is a front view of the locking type pushbutton switch of this invention.
Figure 5:
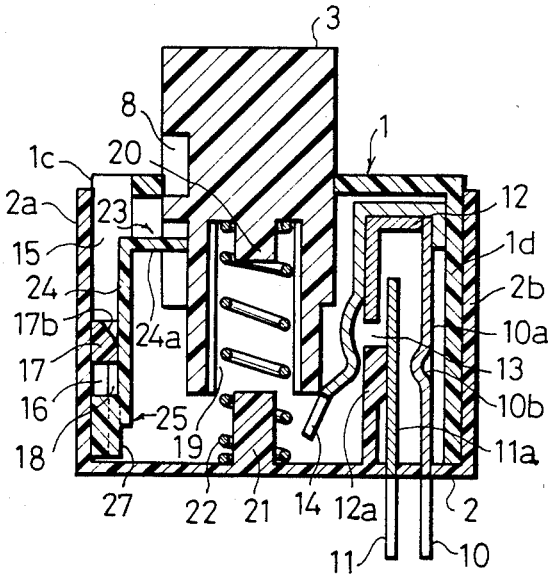
FIG. 5 is a cross-sectional view taken along the line V—V of the switch shown in FIG. 4.
Figure 6:
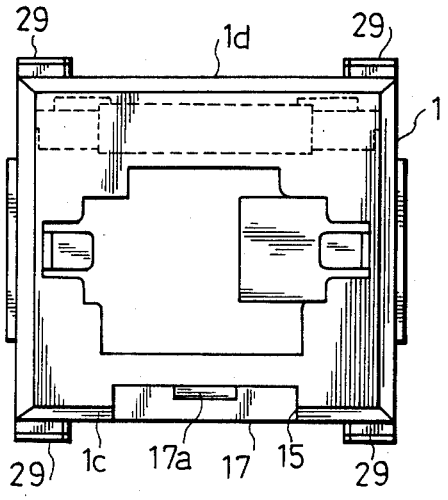
FIG. 6 is a plan view of the upper case of FIG. 4.
Figure 7:
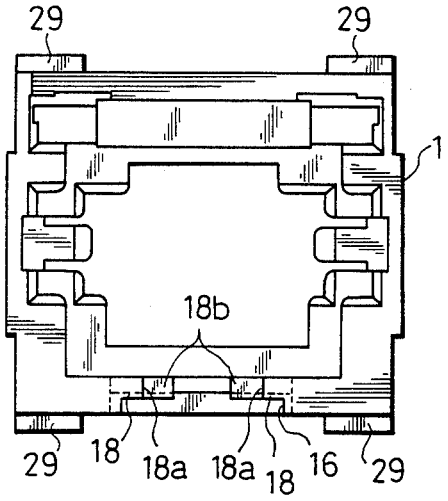
FIG. 7 is a bottom view of the upper case of FIG. 4.
Figure 8:
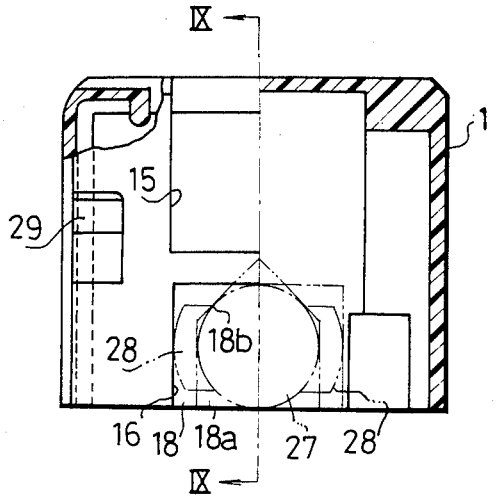
FIG. 8 is a right-half cross-sectional view of the upper case of FIG. 4.
Figure 9:
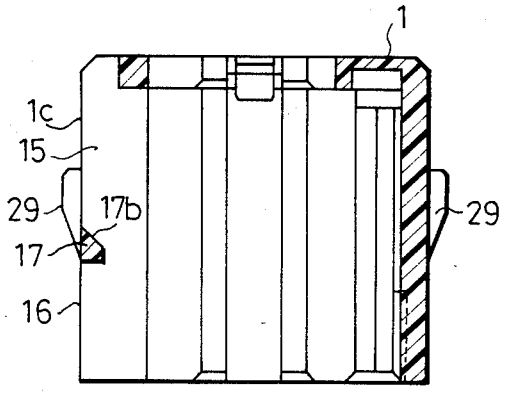
FIG. 9 is a cross-sectional view taken along the line IX—IX of FIG. 8.

When the stem 3 is displaced downwards in opposition to the spring 22 by depressing the push-button (not shown), the end point of the bent part 24*a* of the lock pin 23 moves in the heart-shaped cam groove 8 of FIG. 4 from the position (a) to positions (b), (c) and then reaches the position (d) riding over the step 8*a*. When the pushbutton is released at this position, the stem 3 is displaced upward by the force of spring 22 and thereby the bent part 24*a* is stopped at the position (e) by engaging with the crescent-shaped projection 8*b* of the heart-shaped groove 8. Thereby, the stem 3 is locked so that it no longer can be displaced upward. In this condition, the movable contact 11*a* is placed in contact with the projection 10*b* of the fixed contact 10*a*. Namely, the movable contact 11*a* is closed.

When the pushbutton is further depressed from this condition and the stem 3 is thereby displaced downward, the bent part 24*a* starts to move from the position (e) and then reaches the position (f) after riding over the step part 8*c*. When the pushbutton is released in this condition, the stem 3 is displaced upward by a force of spring 22 and the bent part 24*a* passes the positions (g), (h) and returns to the original position (a). At this position, the movable contact 11*a* is open as in the case of the existing switch.

According to such operation, the lock pin 23 rotates with the circular part 27, the pin part 24 moves to the right and left within the indent 17*a*, and simultaneously, the pin part 24 is flexed in the direction normal to the surface of the heart-shaped cam groove 8.

As described above, this invention provides a locking type pushbutton switch wherein the lock pin is comprised of a pin part having an end held resiliently in contact with the heart-shaped cam groove, and a mounting part which is integrated to the pin part and held by said case. The mounting part has portions adjacent the pin part cut-away, and thereby the pin part is made longer than it would be otherwise. Accordingly, the number of parts can be reduced, the structure can be simplified and moreover size reduction and compact design can be realized. Furthermore, the pin part becomes long and thereby the pin part can have sufficient flexibility and as a result smooth operation of the lock pin can be realized.

According to the locking type pushbutton switch of this invention, the lock pin is held by the upper and lower cases and it is urged into pressure contact with the front surface of the cam of the pushbutton by the resiliency of the pin part itself. Accordingly, the supporting plate for supporting the lock pin and plate spring for energizing the lock pin to the front surface of the cam are no longer required. Therefore, assembling becomes easier and a reduction in number of parts and size can also be realized.

Moreover, a high accuracy has previously been required for relative dimensions between the bending part of the lock pin and the supporting plate inserting hole of the prior art, but since the supporting plate has been eliminated owing to the structure that the lock pin is held by the upper and lower cases, manufacturing can be simplified.

What is claimed is:

1. A locking type pushbutton switch having a casing defined in part by a side wall, a stem portion movable parallel to said side wall for actuating the switch upon movement inwards of said casing and having a cam groove formed on a side surface thereof, and means including a locking pin having an end portion fitting within said cam groove for holding said stem in its position inwardly of said casing, said locking pin including a mounting portion adapted to be held within a recess of said side wall for rotation parallel therewith, an elongate pin part extending outwardly from said mounting portion to a free end and adapted to lie generally along said side wall, and a bent part extending normally from said free end to said end portion so that said elongate portion can be flexed to press said end portion resiliently against said cam groove.

2. A locking type pushbutton switch according to claim 1, said elongate portion extending from a recess formed within said mounting portion to increase the flexibility thereof.

* * * * *